United States Patent [19]

Winterton et al.

[11] Patent Number: 4,734,222

[45] Date of Patent: Mar. 29, 1988

[54] COMPOSITION AND METHOD FOR CLEANING SOFT AND HARD CONTACT LENSES

[75] Inventors: Lynn Winterton, Roswell; Kai C. Su, Alpharetta, both of Ga.

[73] Assignee: Ciba-Geigy Corporation, Ardsley, N.Y.

[21] Appl. No.: 847,986

[22] Filed: Apr. 3, 1986

[51] Int. Cl.[4] ..... C11D 1/75; C11D 3/33

[52] U.S. Cl. ..... 252/546; 252/89.1; 252/174.17; 252/174.19; 252/174.21; 252/174.22; 252/547; 252/DIG. 14; 514/839

[58] Field of Search ..... 252/89.1, 547, 550, 252/551, 174.21, 174.22, DIG. 14, 546, 174.19, 174.17; 514/839

[56] References Cited

U.S. PATENT DOCUMENTS

| | | | |
|---|---|---|---|
| 3,630,929 | 12/1971 | van Dijk | 252/136 |
| 3,776,851 | 12/1973 | Cheng | 252/174.19 |
| 3,850,831 | 11/1974 | Hellsten et al. | 252/99 |
| 3,981,826 | 9/1976 | Munro | 252/526 |
| 4,065,324 | 12/1977 | Rankin | 134/30 |
| 4,326,979 | 4/1982 | Bus et al. | 252/158 |
| 4,394,179 | 7/1983 | Ellis et al. | 134/7 |
| 4,493,783 | 1/1985 | Su et al. | 252/174.23 |

*Primary Examiner*—Prince E. Willis

*Attorney, Agent, or Firm*—Michael W. Glynn; Irving M. Fishman

[57] ABSTRACT

An opthalmic cleaning composition for cleaning a contact lens comprising an effective amount of a water soluble particulate compound for removing proteinaceous, lipid and other non-proteinaceous deposits on the contact lens, wherein the particulate compound is suspended in a predominately non-aqueous water-miscible organic liquid medium which is substantially a non-solvent for the particulate compound, and a method of cleaning a contact lens employing such composition.

9 Claims, No Drawings

COMPOSITION AND METHOD FOR CLEANING SOFT AND HARD CONTACT LENSES

BACKGROUND OF THE INVENTION

Proteinaceous, lipid and other non-proteinaceous deposits build up on contact surfaces while being worn. The deposits, derived from mucus, oils, cosmetics, protein from tear fluid, and the like, not only can result in discomfort to the contact lens user, but an also impair vision and reduce wearing time unless such deposits are removed.

Traditional cleaning solutions generally help to remove many, but not all, such deposits. Particularly difficult to remove are proteinaceous deposits. Accordingly, various heterogeneous suspensions for use in removing such deposits have been proposed. Typically, such compositions contain a water-insoluble particulate material, such as a silica abrasive or polymer microbeads, in a suitable liquid carrier vehicle, such as water thickened with a viscosity modifier. See, for example, U.S. Pat. Nos. 4,493,783 and 4,394,179.

While such compositions are generally useful in removing such deposits, the presence of residual water-insoluble particulate materials on the contact lens surface can result in patient irritation or even corneal abrasions. Therefore, in using such prior art heterogeneous suspensions, thorough rinsing of such lenses is indicated.

It would be highly desirable to obviate the need for thorough rinsing to remove particulate material arising from the cleaner composition.

It has now been surprisingly found that drawbacks associated with the use of such heterogeneous compositions of the prior art can be obviated, while still retaining the cleansing advantages associated with heterogeneous suspensions, by employing a water soluble particulate compound suspended in a predominately non-aqueous water-miscible organic liquid medium, as described hereinafter.

Thus, it is an object of the present invention to provide the artisan with a method of cleaning hard and soft contact lenses by applying such compositions to the lens surfaces, and rubbing the lens surface in the presence of such compositions to remove proteinaceous and non-proteinaceous deposits, and subsequently contacting the cleaned lenses with an aqueous medium to dissolve and remove any associated particulate lens cleaning material from the lens surfaces.

It is a further object of the present invention to provide the artisan with compositions useful in such method.

These and other objects of the present invention are apparent from the following disclosures.

DETAILED DESCRIPTION OF THE INVENTION

One embodiment of the instant invention relates to a heterogeneous composition for cleaning a contact lens comprising an effective amount of a water soluble particulate compound for removing proteinaceous and non-proteinaceous deposits which normally accumulate on the surface of said contact lens when worn by a host, wherein the particulate compound is suspended in a predominately non-aqueous water-miscible organic liquid medium which is substantially a non-solvent for said particulate compound.

The nature of the water soluble particulate compound can vary widely. However, suitable particulate compounds should be chemically inert to the contact lens material in the environment of use. Thus, the particulate compound should not chemically react with the surface of the lens so as to irreversibly modify the same. Moreover, the particulate form of the compound should be physically inert to the contact lens material, i.e. the particles should not substantially scratch or abraid the surface of the lens material so as to render the lens material unsuitable for use. Accordingly, the water-insoluble particulate material is advantageously chosen so as to be substantially devoid of lens tearing irregularities in the environment of use.

The water soluble particulate material generally has a particle size averaging below about 750 microns, and more preferably is between about 500 microns and about 1 micron, and most preferably between about 200 microns and 1 micron.

The particulate component should be sufficiently water soluble such that particles thereof in the heterogeneous composition will dissolve upon placing such composition in water or aqueous solution under ambient conditions.

The hardness of the chosen particulate material is not critical. However, the resistance of the chosen particulate material to permanent deformation under the rubbing stress associated with cleaning of the lens surfaces should, at a minimum, be sufficient so as to enable the effective removal of proteinaceous and non-proteinaceous deposits.

Suitable particulate water soluble materials include water soluble crystalline or glassy inorganic and organic compounds and mixtures thereof. Advantageously, such compounds are those which are isosmotic with isotonic sodium chloride at an aqueous concentration between about 3 to about 20 percent by weight, preferably from about 4 to about 15 percent by weight, most preferably from about 8 to about 12 percent by weight. By isotonic sodium chloride herein is meant an aqueous sodium chloride solution containing 0.9 percent by weight sodium chloride.

Preferably, the particulate compound is pharmaceutically acceptable in an ocular environment. Especially advantageous are those particulate compounds which, upon solution with water, are substantially non-irritating to the eye.

Specific compounds for use as the particulate component in the present compositions, and their approximate isosmotic concentration (weight percent) in respect to isotonic sodium chloride, include, but are not limited to the following: potassium alum (6.35%), sodium p-aminosalicylate (3.27%)), amphetamine sulfate (4.23%), arginine glutamate (5.37%), bismuth sodium tartrate (8.91%), calcium disodium edetate (4.50%), calcium lactate (4.5%), citric acid (5.52%), dextrose (5.51%), dextrose anhydrous (5.05%), disodium edetate (4.44%), ephedrine hydrochloride (3.2%), epinephrine bitartrate (5.7%), D-fructose (5.05%), galactose (anhydrous)(4.92%), D-glucuronic acid (5.02%), heparin sodium (12.2%), lactose (9.75%), magnesium sulfate (6.3%), mannitol (5.07%), N-methylglucamine (5.02%), sodium citrate (3.02%), dibasic sodium phosphate dodecahydrate (4.45%), sodium succinate (2.90%), sodium sulfate (3.95%), sucrose (9.25%), tartaric acid (3.9%), trisodium edetate monohydrate (3.31%) and zinc sulfate (7.65%), and mixtures thereof.

In general, preferred compounds include sugars, such as monosaccharides; including pentoses, hexoses and heptoses; disaccharides, such as sucrose, maltose and lactose; and trisaccharides such as raffinose, and the water soluble pharmaceutically acceptable derivatives thereof. Also, saccharin is preferred.

Most preferred as the particulate component is sucrose.

The nature of the suspending agent can also vary widely. Preferred water-soluble liquid dispersants include conventional, inert organic water soluble organic media which are substantially non-solvents for the suspended particulate material. Highly preferred are those suspending agents which are pharmaceutically acceptable.

Suitable suspending agents include liquid substantially nonionic organic dispersants such as glycerine, polypropyleneglycol, polyethyleneglycol, lower alkanols, such as ethanol or isopropanol, lower alkyl ethers such as diethylether, lower alkyl esters, such as isoamyl acetate, and mixtures thereof, as well as substantially non-aqueous pharmaceutically acceptable surface active agents, including, but not limited to polyethoxylated alkanols of 6 to 20 carbon atoms, polysorbates, tyloxapol, polyethoxylated alkylphenyls, polyethoxylated polypropylene glycols, polyethoxylated fatty acids, polyethoxylated fatty acid amides, polyethoxylated amines, higher alkyl sulfates, higher alkyl sulfonates, ethoxylated higher alkyl sulfates, ethoxylated monoglycerides of fatty acids, higher alkyl amine oxides, and the like. Preferably, the suspending media is substantially nonionic in character.

Suitable dispersants and dispersant components are widely available and include, but are not limited to, polyoxamers, such as Pluronice surfactants (BASF Wyandotte), including for example poloxamer 401, 402, 331, 333, 282, 231, 235, 182, 124, and 105; polysorbates, such as Tween ® surfactants (ICI Americas), including for example polysorbate 20, 40, 60, 65, 80 and 85; tyloxapol, such as Superinone ® detergent (Winthrop); polypropylene glycols, such as those having average molecular weights between about 500 and about 5000, including PPG 2025 with an average molecular weight of about 2000, or PPG 3025 with an average molecular weight of about 3000; polyethylene glycols, such as those having an average molecular weight between about 300 and about 6000, including polyethylene glycol 300, 400, 600, 1500, 1540, 4000 and 6000; amine oxides of N-higher alkyl, N,N-dilower alkyl amines, such as N,N-dimethyl-N-laurylamine oxide; ethoxylated monoglycerides of fatty acids, such as the polyethoxylated (30 average units) monoglyceride of coco fatty acid, the polyethoxylated (67 average units) monoglyceride of coco fatty acid, or the polyethoxylated (82 average unites) monoglyceride of tallow fatty acid; and polyethoxylated fatty acids and alcohols, such as Myrj ® or Brij ® surfactants (ICI Americas) including polyoxyl 8 stearate, polyoxyl 40 stearate, polyoxyl 50 stearate, polyoxyl 10 oleyl ether, and the like.

The liquid medium, made up of one or more suspending agents, may be a pourable liquid or in the form of a non-pourable viscous liquid, such as a jelly, under ambient conditions. As can be appreciated, where the liquid medium is made up of various constituents, one or more individual components thereof may solid under ambient conditions, so long as the mixture constituting the suspending medium is liquid, preferably a homogeneous liquid.

If desired, the liquid medium may contain minor amounts of thickeners, such as polyvinyl alcohol, gelatin, agar-agar and the like. In general, when present, there is between about 0.1 to about 5 weight percent of such thickener present, based on the weight of composition.

Additionally, if desired, the liquid medium may also contain minor amounts of one or more conventional opthamologically compatable adjuvants, such as preservatives, including bactericides or fungistats, and fragrances and the like. In general, when present, there is between about 0.1 to about 2 weight percent of such adjuvants present, based on the weight of the composition.

In addition, the organic liquid medium may contain minor amounts of water present therein. As can be appreciated, the upper limit for the amount of water tolerable in the instant compositions is dependent on the nature of the particulate water-soluble material and the organic constituents of the liquid suspending medium. For example, where the liquid suspending medium is significantly water binding, as in the case where polyethylene glycol or various polyethoxylated derivatives of organic compounds are employed, upwards of up to about 50 percent by volume water may be tolerated, based on the total volume of the liquid medium, without substantially solvating the water soluble particulate material. A small amount of water in the liquid organic suspending medium is advantageous in removing sharp, potentially lens abrasive, irregularities from the water soluble particulate material.

For example, in one embodiment of the invention, the water soluble particulate material, which is preferably in the crystalline or glassy state, having an average particle size below about 750 microns, is dispersed, such as by stirring or gentle agitation at a temperature between about 10° C. to about 30° C. with an organic liquid medium which is substantially a non-solvent for the particulate material in that it is capable of solvating only sparing amounts of the particulate material, for example, generally less than 20 weight percent, preferably less than 10 percent, of the amount of particulate material combined with the liquid medium. Nevertheless, this very slight solvating effect of the medium is ordinarily sufficient to remove sharp potentially lens abrasive irregularities, thereby resulting in particles generally devoid of sharp edges, dispersed in the liquid medium.

Alternatively, the water soluble particulate materials, as employed, may be devoid of sharp, potentially lens abrasive, irregularities. For example, the water soluble particulate material, which is preferably crystalline or glassy in nature, may be first treated with a liquid medium in which the particulate material is soluble, e.g. by briefly mixing with agitation, to remove by solvation sharp edges from the particulate matter. After treatment, the particulate matter can be suitably dried, e.g. using conventional fluidized drying techniques, or by tumbling under drying conditions, such as under reduced pressure. The treated particulate material, now suitably devoid of sharp lense tearing edges, is then dispersed in the non-solvent medium, for example by stirring or agitating the heterogeneous mixture.

The amount of particulate water-soluble compound in the heterogeneous composition can vary widely, but is generally between about 1 and about 60 percent by weight, preferably between about 1 and about 40 percent by weight, most preferably between about 1.5 and about 20 percent by weight, based on the weight of the total composition.

The contact lens can be cleaned using the opthalmic cleaning compositions of the instant invention by techniques known, per se, in the art.

For example, the lens to be cleaned is removed from the eye, or storage container, and placed on the palm of one hand. The instant opthalmic cleaning composition is applied e.g. using a conventional eye-dropper, a squeeze tube applicator, or the like, to place an effective cleaning amount, e.g. a few drops or its volume equivalent, onto the contact lens surface to be cleaned. The cleaning composition is then rubbed onto the surface of the contact lens to remove proteinaceous and non-proteinoceous deposits, for a suitable period of time, e.g. for about 15 to about 30 seconds, using the index finger or thumb of the other hand.

After cleaning, the lens can be briefly rinsed, for example with water or other aqueous conventional opthamologically acceptable rinsing solution, such as an isotonic saline solution, and placed into the eye. During the brief rinsing step, the particulate material in the cleaning composition dissolves, thereby obviating the risk of eye irritation which may be occasioned where water insoluble particulates, such as silica abrasives or plastic polymer microbeads, are employed.

Alternatively, the lens, after cleaning, may be placed directly in either an aqueous chemical disinfection system, such as those employing aqueous hydrogen peroxide, without intermediate rinsing, or in an aqueous heat disinfection unit employing saline or other aqueous heat disinfection solutions, following manufacturers recommended disinfection schemes, prior to placing the lens in the eye of the host.

The rinsing, either by contact with an aqueous rinsing solution or an aqueous disinfection system, also serves to disperse the deposits removed or dislodged from the lens surface during the rubbing step.

The following examples are for illustrative purposes only and are understood not to be limiting of the scope of the invention. All parts are by weight unless otherwise specified.

EXAMPLE 1

To a 500 ml beaker there is added 50 ml water, 50 ml polysorbate 80 (Tween® 80 brand-ICI Americas) and 50 ml polysorbate 20 (Tween® 20 brand-ICI Americas) and the mixture stirred to provide a clear homogeneous solution under ambient conditions. To this solution there is added 20 grams of crystalline sucrose having an average particle size of about 100 microns while stirring. The resulting thick heterogenous suspension does not settle after 24 hours. Upon applying a few drops (3–4) to a contact lens and rubbing the composition onto the surface thereof, the composition cleans the lens of surface deposits. Upon rinsing the lens with water, the lens rinses well, leaving no apparent residue on the lens surface.

EXAMPLE 2

Using the procedure of Example 1, there is combined 50 ml polyethylene glycol having a weight average molecular weight of 2000 and 50 ml polysorbate 20. To this liquid medium there is admixed 20 grams sucrose, having an average size of about 100 microns. The composition does not settle after 24 hours, is somewhat thinner than that of Example 1 and contact lenses cleaned therewith are found to rinse well, having no apparent residue on the lens surface.

EXAMPLE 3

Using the procedure of Example 1, 50 ml glycerine is admixed with 10 grams of sucrose, having an average size of about 100 microns. The resulting composition does not settle after 24 hours and rinses very well from contact lenses.

EXAMPLE 4

Using the procedure of Example 1, 50 ml polyethylene glycol having a weight average molecular weight of about 2000 is admixed with 10 grams of sucrose. While the composition is stable and does not settle out after 24 hours, and is satisfactory as a cleaning composition for contact lenses, it does not rinse as well as the composition of Example 3 from contact lenses.

EXAMPLE 5

Using the procedure of Example 1, 50 ml polypropylene glycol having a weight average molecular weight of about 400 is admixed with 10 grams of sucrose. The composition is stable after 24 hours and rinses very well from contact lenses.

EXAMPLE 6

Using the procedure of Example 1, 50 ml polyethylene glycol having a weight average molecular weight of about 400 is admixed with 10 grams of sucrose. The composition is stable and does not settle out after 24 Hours, and rinses very well from contact lens surfaces. It appears thinner in consistency than the composition of Example 5.

EXAMPLE 7

Using the procedure of Example 1, 50 ml polyethylene glycol having a weight average molecular weight of about 400 is combined with 50 ml dimethyl lauryl amine oxide. To this mixture is added 10 grams sucrose. While this composition rinses well from contact lens surfaces, the composition is not as stable as that of Example 6 and some separation occurs after about 22 hours.

EXAMPLE 8

Using the procedure of Example 1, 50 ml polysorbate 20, 50 ml polyethylene glycol, 10 ml water are admixed and to this solution there is added 20 grams sucrose. The composition effectively cleans contact lenses and rinses well. However, the mixture tends to separate rapidly and thus must be shaken before using.

EXAMPLE 9

Using the procedure of Example 1, 50 ml ethoxylated (average of about 30 units) monoglyceride of coco fatty acid, 5 ml polyethylene glycol having a weight average molecular weight of about 400 and 20 grams sucrose are admixed. The composition is stable and viscous and is suitable for cleaning contact lenses although it does not rinse as well as that of Example 1.

EXAMPLE 10

Using the procedure of Example 1, 50 ml dimethyl laurylamine oxide, 50 ml glycerine, 25 ml polyethylene glycol having a weight average molecular weight of about 2000 and 20 grams of sucrose are combined. Unfortunately this particular combination of dispersants acts as a solvent for the sugar and is not useable as evident by inspection.

EXAMPLE 11

Using the procedure of Example 1, 90 ml polypropylene glycol having a weight average molecular weight of about 2000, 5 ml polysorbate 80, and 5 ml poloxamer 282 are combined and admixed with 2.5 grams sucrose. The resulting composition possesses excellent stability, cleaning properties and rinsibility from contact lens surfaces.

EXAMPLE 12

Using the procedure of Example 1, 90 ml polypropylene glycol having a weight average molecular weight of about 3000, 5 ml polysorbate 80, 5 ml poloxamer 282 are combined and admixed with 2.5 grams sucrose. The resulting composition possesses excellent stability, cleaning properties and rinsibility from contact lens surfaces.

EXAMPLE 13

Using the procedure of Example 1, 80 ml polypropylene glycol having an average molecular weight of about 700, 10 ml poloxamer 231, and 10 ml polysorbate 80 were combined with 3 grams sucrose. The resulting composition was found to be suitable for cleaning contact lenses, especially for cleaning hard contact lenses, such as rigid gas permeable contact lenses.

EXAMPLE 14

Using procedure of Example 1, 80 ml polyethylene glycol having an average molecular weight of about 400, 10 ml poloxamer 231 and 10 ml polysorbate 80 were combined with 1.5 grams sucrose. The resulting composition was useful in cleaning contact lenses, especially rigid gas permeable contact lenses.

EXAMPLE 15

Using the procedure of Example 1, 90 ml polyethylene glycol having an average molecular weight of about 400, and polysorbate 80 were combined with 1.5 grams sucrose. The composition was found to be especially suitable for cleaning rigid gas permeable contact lenses.

EXAMPLE 16

Using the procedure of Example 1, 70 ml polyethylene glycol having an average molecular weight of about 400, 10 ml polypropylene glycol having an average molecular weight of about 700, 10 ml polysorbate 80 and 10 ml poloxamer 231 are combined with 1.5 grams sucrose to obtain a composition found suitable for cleaning contact lenses, especially rigid gas permeable lenses.

EXAMPLE 17

Using the procedure of Example 1, 40 ml polypropylene glycol having an average molecular weight of about 1000, 40 ml polypropylene glycol having an average molecular weight of about 2000, 10 ml polysorbate 80 and 10 ml poloxamer 231 were combined with 3 grams sucrose. The resulting composition is useful in cleaning contact lenses and is especially preferred cleaning soft hydrophilic hydrogel contact lenses.

EXAMPLE 18

The procedure of Example 17 is repeated except that 2 grams mannose is employed instead of 3 grams sucrose. The resulting composition is useful in cleaning hard and soft contact lenses.

EXAMPLE 19

The procedure of Example 17 is repeated, except that 5 grams lactose is employed instead of 3 grams sucrose. Again the resulting composition is useful in cleaning hard and soft contact lenses.

EXAMPLE 20

Using the procedure of Example 1, 80 ml poloxamer 105 and 20 ml polysorbate 80 are combined with 3 grams sucrose. The resulting composition is useful in cleaning both hard and soft lenses.

What is claimed is:

1. A heterogeneous composition for cleaning a contact lens comprising a contact lens cleaning effective amount of an ocularly acceptable, water-soluble, particulate organic compound selected from sodium p-aminosalicylate, amphetamine sulfate, arginine glutamate, bismuth sodium tartarte, calcium disodium edetate, calcium lactate, citric acid, disodium edetate, ephedrine hydrochloride, ephedrine bitartrate, a sugur, D-glucuronic acid, heparin sodium, mannitol, N-methylglucamine, sodium citrate, sodium succinate, tartaric acid, and trisodium ededate monohydrate, said particulate compound having a particle size between about 1 micron and below about 750 microns and substantially devoid of soft contact lens tearing irrregularities, which compound, in aqueous solution at a concentration between about 3 and 20% by weight, is isosmotic with isotonic sodium chloride; and a predominantly non-aqueous, water-miscible, substantially non-ionic, ocularly acceptable, organic liquid suspending medium which is substantially a non solvent for said particulate compound and is selected from polypropylene glycol, polyethylene glycol, polyethoxylated alkanols of 6–20 carbons, polysorbates, tyloxapol, polyethoxylated alkylphenols, polyethoxylated polypropylene glycols, polyethoxylated fatty acids, polyethoxylated fatty acid amides, polyethoxylated amines, ethoxylated monoglycerides of fatty acids, and higher alkyl amine oxides;

said compound being dispersed in said suspending medium.

2. The composition of claim 1 wherein said particle size is between about 1 and 500 microns and said compound is present in said composition in an amount of from about 1 to about 60% by weight.

3. The composition of claim 1 wherein said compound is a water-soluble crystalline compound.

4. The composition of claim 1 wherein said compound, upon solution with water is substantially non-irritating to the eye.

5. The composition of claim 4 wherein said compound, in aqueous solution between about 8 and about 12% by weight, is isosotic with isotonic sodium chloride.

6. The composition of claim 1 wherein said compound is a sugar.

7. The composition of claim 6 wherein said sugar is sucrose.

8. A method of cleaning a contact lens contaminated with proteinaceous and non-proteinaceous deposits comprising (1) applying onto the surface of a contact lens to be cleaned, an effective cleaning amount of the composition of claim 1;

(2) rubbing said composition onto said surface for a period sufficient to remove said proteinaceous and said non-proteinaceous deposits therefrom; and (3) then contacting sid lens with an aqueous solution to rinse said lens.

9. A method of cleaning a contact lens contaminated with proteinaceous and non-proteinaceous deposits comprising (1) applying onto the surface of a contact lens to be cleaned, an effective cleaning amount of a heterogeneous composition suitable for cleaning said lens comprising a contact lens cleaning effective amount of an ocularly acceptable, water-soluble, particulate compound selected from sodium p-aminosalicylate, amphetamine sulfate, arginine glutamate, bismuth sodium tartrate, calcium disodium edetate, calcium lactate, citric acid, disodium edette, ephedrine hydrochloride, ephedrine bitartrate, a sugar, D-glucuronic acid, heparin sodium, mannitol, N-methyglucamine, sodium citrate, sodium sucinate, tartaric acid, trisodium ededate monohydrate, potassium alum, magnesium sulfate, dibasic sodium phosphate dodecahydrate, sodium sulfate, and zinc sulfate, said particulate compound having a particle size between fabout 1 micron and below about 750 microns and substantially devoid of soft contact lens tearing irregularities, which compound, in aqueous solution at a concentration between about 3 and 20% by weight, is isosmotic with isotonic sodium chloride; and a predominantly non-aqueous, water-miscible, substantially non-ionic, ocularly acceptable, organic liquid suspending medium which is substantially a non solvent for said particulate compound and is selected from polypropylene glycol, polyethylene glycol, polyethoxylated alkanols of 6–20 carbons, polysorbates, tyloxdapol, polyethoxyated alkylphenols, polyethoxylated polypropylene glycols, polyethoxylated fatty acids, polyethoxylated fatty acid amides, polyethoxylated amines, ethoxylated monoglycerides of fatty acids, higher alkyl amine oxides, glycerine, lower alkanols, lower alkyl ethers, and lower alkyl esters, said compound being dispersed in said suspending medium, (2) rubbing said composition onto said surface for a period sufficient to remove said proteiaceous and said non-proteinaceous deposits therefrom; and (3) then contacting said lens with an aqueous solution to rinse said lens.

* * * * *